US009255501B2

(12) United States Patent
Esposito

(10) Patent No.: US 9,255,501 B2
(45) Date of Patent: Feb. 9, 2016

(54) THREADLESS MAGNETIC OIL DRAIN PLUG

(76) Inventor: Peter Esposito, Warwick, NY (US)

( * ) Notice: Subject to any disclaimer, the term of this patent is extended or adjusted under 35 U.S.C. 154(b) by 54 days.

(21) Appl. No.: 14/236,278

(22) PCT Filed: Aug. 1, 2012

(86) PCT No.: PCT/US2012/049149

§ 371 (c)(1),
(2), (4) Date: Jun. 17, 2014

(87) PCT Pub. No.: WO2013/019854

PCT Pub. Date: Feb. 7, 2013

(65) Prior Publication Data

US 2014/0367386 A1 Dec. 18, 2014

Related U.S. Application Data

(63) Continuation of application No. 13/197,469, filed on Aug. 3, 2011, now abandoned.

(51) Int. Cl.
*F16N 21/06* (2006.01)
*F01M 11/04* (2006.01)

(52) U.S. Cl.
CPC ... *F01M 11/0408* (2013.01); *F01M 2011/0416* (2013.01)

(58) Field of Classification Search
CPC ..... F16N 31/00
USPC ..... 184/1.5; 220/345.6
See application file for complete search history.

(56) References Cited

U.S. PATENT DOCUMENTS 2,727,650 A * 12/1955 Moynihan ..... F16L 55/1683 138/99
2,755,932 A 7/1956 Cohn
3,592,250 A * 7/1971 Petroshanoff ..... 411/320
3,800,914 A 4/1974 Miyata
3,973,549 A 8/1976 Drummond
4,145,939 A * 3/1979 Garrison ..... B25B 13/06 81/125
4,361,310 A 11/1982 Cummins
4,449,613 A * 5/1984 Price ..... 184/1.5

(Continued)

FOREIGN PATENT DOCUMENTS

WO WO 2013/019854 A1 2/2013

OTHER PUBLICATIONS

U.S. Appl. No. 12/908,224, filed Oct. 20, 2010.

(Continued)

*Primary Examiner* — William E Dondero
*Assistant Examiner* — Mark K Buse
(74) *Attorney, Agent, or Firm* — Greenberg Traurig, LLP

(57) ABSTRACT

A threadless oil plug is provided for threadlessly sealing a drain hole of an oil pan. The plug has a disc-shaped magnet and a cylindrical stem that projects outwardly from the magnet. A gasket is fastened around the stem in juxtaposition with a planar surface of the magnet. The stem is adapted for insertion into the drain hole of an oil pan, thereby centering the magnet and magnetically sealing the gasket around the drain hole. A removal tool has a hand grip with a splash guard. The hand grip and the splash guard are attached to a magnet. To remove the plug, the magnet of the removal tool is magnetically fastened to the magnet of the plug so that the plug may be safely removed from the drain hole in one motion. The plug is reinstalled in the drain hole in one motion, without the use of any tools.

18 Claims, 16 Drawing Sheets

(56) References Cited

U.S. PATENT DOCUMENTS

| | | | | |
|---|---|---|---|---|
| 4,503,934 | A | 3/1985 | Stephanus et al. | |
| 4,695,088 | A | 9/1987 | Jensen | |
| 4,699,846 | A | 10/1987 | Ohya et al. | |
| 4,752,759 | A | 6/1988 | Kazuyuki | |
| 4,763,092 | A | 8/1988 | Tomita | |
| 4,810,148 | A | 3/1989 | Aisa et al. | |
| 5,107,808 | A * | 4/1992 | Mahn et al. | 123/195 C |
| D341,142 | S | 11/1993 | Rogers et al. | |
| 5,314,625 | A * | 5/1994 | Farnelli | B01D 21/0009 184/6.25 |
| 5,420,557 | A | 5/1995 | Chern | |
| 5,433,410 | A * | 7/1995 | Foltz | 251/100 |
| 5,465,078 | A * | 11/1995 | Jones, Jr. | 335/305 |
| 5,564,526 | A | 10/1996 | Barnard | |
| 5,628,601 | A | 5/1997 | Pope | |
| 5,634,755 | A * | 6/1997 | Jones, Jr. | 411/383 |
| 5,949,317 | A * | 9/1999 | Fink | B03C 1/286 335/305 |
| 6,078,238 | A | 6/2000 | Gerold | |
| 6,206,344 | B1 | 3/2001 | Takahara | |
| 6,473,946 | B1 | 11/2002 | Cheng | |
| 6,558,541 | B1 * | 5/2003 | Morrison | 210/222 |
| 6,872,039 | B2 | 3/2005 | Baus et al. | |
| 7,357,225 | B2 * | 4/2008 | Dorian | 184/1.5 |
| 7,427,181 | B2 | 9/2008 | Denton et al. | |
| 2007/0175792 | A1 * | 8/2007 | Gregerson | H01L 21/67376 206/711 |
| 2008/0135335 | A1 | 6/2008 | Lowman | |
| 2008/0258854 | A1 * | 10/2008 | Davis | H01F 7/0263 335/285 |
| 2009/0101440 | A1 * | 4/2009 | Morgan | 184/1.5 |
| 2011/0315566 | A1 * | 12/2011 | Boynton | A45C 11/16 206/6.1 |
| 2013/0032434 | A1 | 2/2013 | Esposito | |

OTHER PUBLICATIONS

International (PCT) Application No. PCT/US2010/53303, filed Oct. 20, 2010.

International Search Report and Written Opinion for International (PCT) Patent Application No. PCT/US2012/049149, mailed Oct. 25, 2012.

International Preliminary Report on Patentability for International (PCT) Patent Application No. PCT/US2012/049149, mailed Feb. 4, 2014.

* cited by examiner

THREADLESS MAGNETIC OIL DRAIN PLUG

FIELD OF THE INVENTION

The present invention relates to an oil drain plug and, more particularly, to a threadless magnetic oil drain plug.

BACKGROUND OF THE INVENTION

The internal combustion engine has long been lubricated by oil. The oil is pooled in a pan-like structure called an oil pan, which is attached to the bottom of the engine. When the oil breaks down (i.e., loses its lubricating efficiency during use), it must be periodically removed from the oil pan and fresh oil must be added to the oil pan in a process known as an oil change. Many oil changes occur over the lifetime of the engine, and in order to accommodate numerous oil changes, the oil pan is fabricated with a drain hole through which the broken down oil is normally removed. However, in order for the oil to pool in the oil pan, the drain hole must be sealed. Likewise, in order for the oil to be drained from the oil pan, the drain hole must be unsealed. To accomplish this, the perimeter of the drain hole is usually fabricated with a ring shaped insert positioned therein. The insert has threads which permit a bolt-like threaded drain plug to be screwed into the threads of the insert, to seal the drain hole, and unscrewed from the threads, to unseal the drain hole.

The repetitious screwing and unscrewing of the threaded-drain plug into and out of the threaded-drain hole results in the threads of the insert and the threads of the drain plug becoming worn over long periods of use. Also, metal particles that are not cleared out the threads of the insert and the threads of the drain plug following each oil change cause wear on the threads. When the wear on the threads of the insert and the threads of the drain plug reaches a point where the drain plug is no longer able to be screwed into in the drain hole without it leaking, or it becomes completely unscrewed from the drain hole (i.e., by the vibrations of the oil pan during the operation of the engine), an accidental oil spill will occur.

An accidental oil spill that occurs in this manner creates an adverse impact on the environment, a safety hazard for slipping or falling, and damage to the engine (i.e., through extended operation of the engine without oil in the oil pan). Also, the threads of the insert and the threads of the drain plug are occasionally damaged by improper drain plug installation procedures such as when the drain plug is over tightened or when its threads are cross-threaded with the threads of the drain hole.

Presently, the repair of a worn or cross-threaded drain plug may be accomplished by replacing the worn drain plug with a new one. The repair of the worn or cross-threaded threads of the threaded-insert of the drain hole is usually accomplished by replacing the entire oil pan, which is costly and time consuming. What is needed, but has yet to be provided, is an oil drain plug which completely replaces the wear and failure prone threads of conventional threaded drain plugs.

SUMMARY OF THE INVENTION

A device for sealing a drain hole of an oil pan includes a plug dimensioned to obstruct the drain hole. In an embodiment, the plug has a magnetic body and a sealing mechanism positioned on the plug such that magnetic forces emanating from the magnetic body releasably attach the plug to an oil pan so as to obstruct a drain hole therein, which is sealed in a liquid-tight manner by the sealing mechanism. The device further includes orienting means for orienting the plug relative to a drain hole of an oil pan. In an embodiment, the orienting means includes a stem which projects outwardly from a first side of the magnetic body. The stem may be provided with a detent mechanism adapted to assist in the releasable attachment of the plug to an oil pan. In an embodiment, the detent mechanism includes at least one projection extending radially outward from the stem and movable between an extended position, in which the projection extends radially outward from the stem a first distance, and a retracted position, in which the projection extends radially outward from said stem a second distance which is less than the first distance, or in which the projection is retracted within the stem. In an embodiment, a pair of projections is provided, each projection being resiliently urged from its retracted position toward its extended position.

The sealing mechanism of the plug may be in the form of a compliant member positioned on the first side of the magnetic body about the stem. In an embodiment, the compliant member includes a gasket. In another embodiment, the compliant member is a rubber coating.

In an embodiment, the stem of the device is made from magnetic conducting material, whereby the stem is enabled to attract metallic particles to exterior surfaces of the stem. The stem may be provided with a plurality of through bores to thereby increase the exterior surface area of the stem.

In another embodiment, the orienting means of the device includes at least one projection extending radially outward from a peripheral sidewall of the magnetic body and being movable between an extended position, in which the projection extends radially outward from the magnetic body a first distance, and a retracted position, in which the projection extends radially outward from the magnetic body a second distance which is less than the first distance, or in which the projection is retracted within the magnetic body. In an embodiment, a plurality of projections is provided, each projection being resiliently urged from its retracted position toward its extended position.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION OF THE EXEMPLARY EMBODIMENTS

Although the present invention can be used in conjunction with any type of fluid reservoir that has a drain plug removably fitted thereto, it is particularly suitable for use in connection with a steel oil pan of an internal combustion engine. Accordingly, the present invention will be described hereinafter in connection with a drain plug for an oil pan of an internal combustion engine. It should be understood, however, that the following description is only meant to be illustrative of the present invention and is not meant to limit the scope of the present invention, which has applicability to other types of fluid reservoirs with drain plugs.

Figure 1:
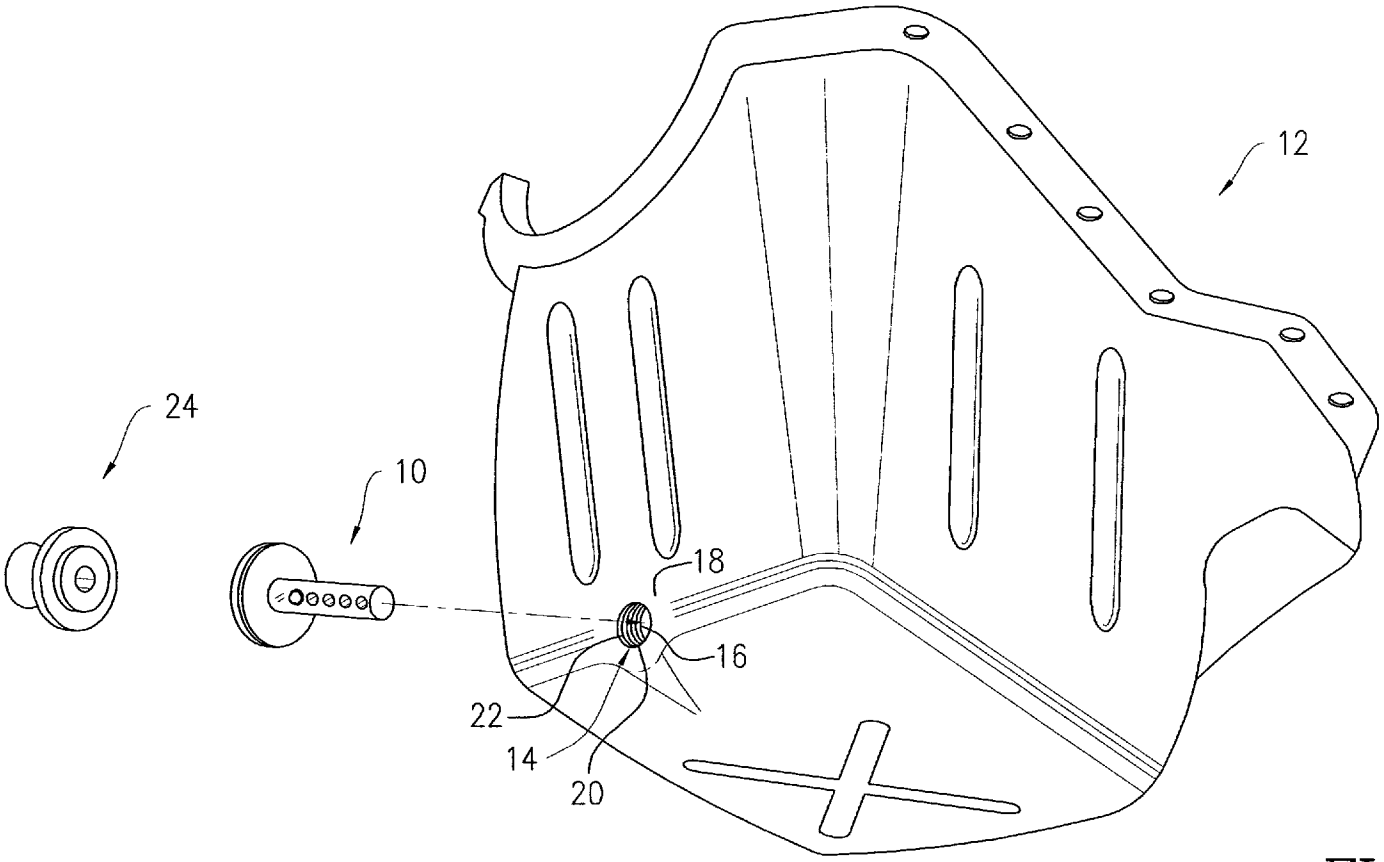
FIG. 1 is a perspective view of a threadless magnetic oil drain plug and a magnetic removal tool constructed in accordance with one embodiment of the present invention, the threadless magnetic drain plug and the magnetic removal tool being shown positioned externally to a conventional oil pan having a conventional drain hole with a threaded insert.
Figure 2:
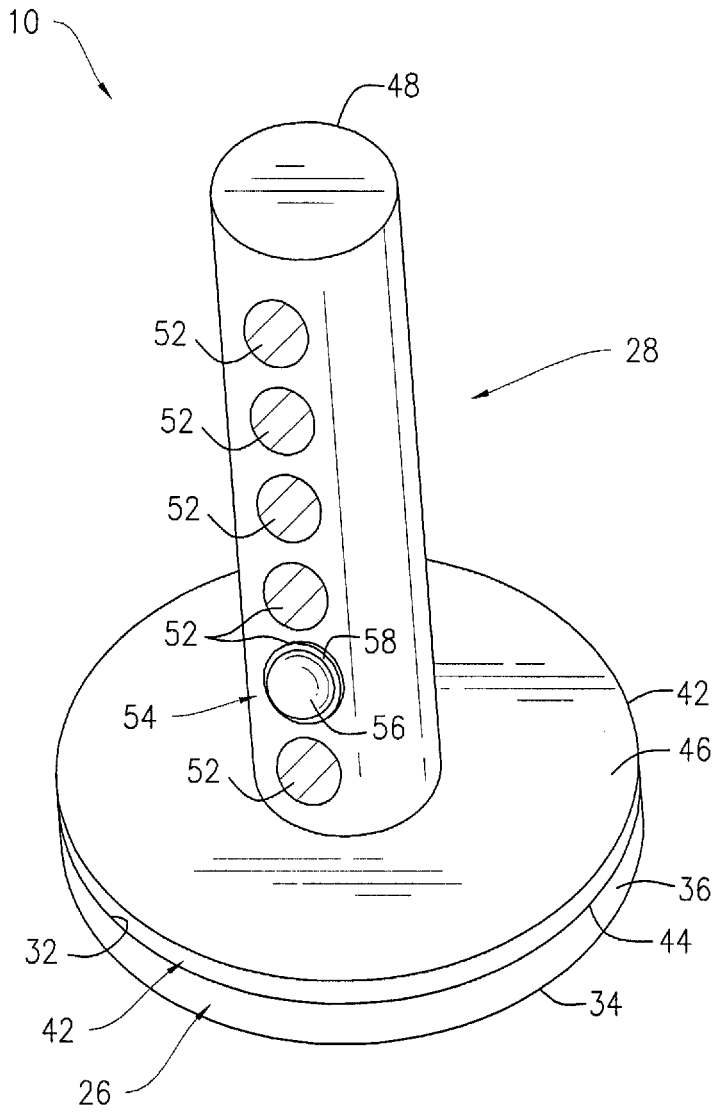
FIG. 2 is a perspective view of the threadless magnetic drain plug shown in FIG. 1.
Figure 3:
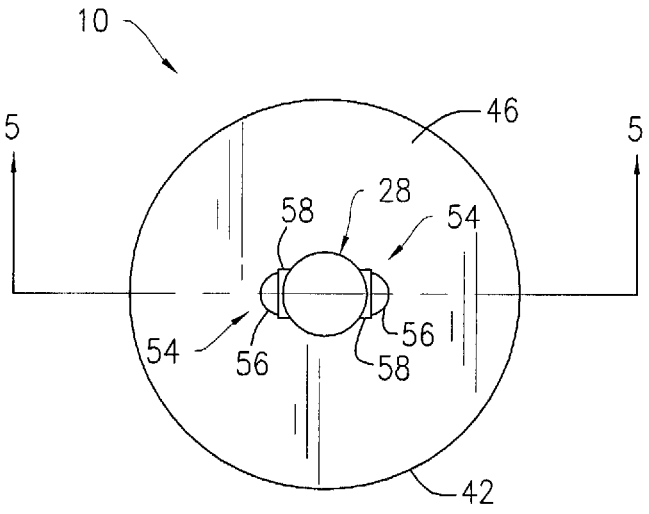
FIG. 3 is a plan view of the threadless magnetic drain plug shown in FIG. 1.
Figure 4:
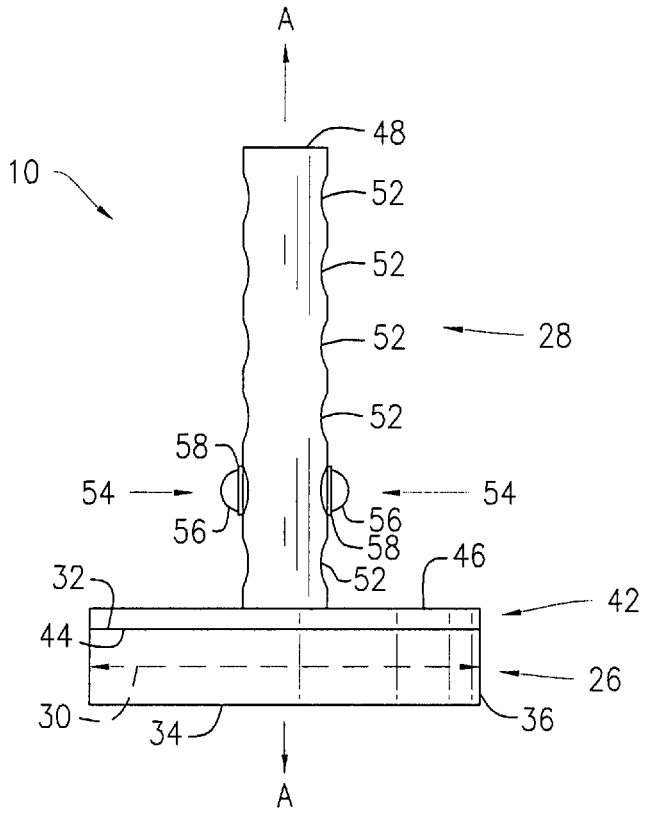
FIG. 4 is a side elevational view of the threadless magnetic drain plug shown in FIG. 1.

FIG. 1 illustrates a threadless magnetic oil drain plug (hereinafter "the plug 10) constructed in accordance with an exemplary embodiment of the present invention. A conventional steel oil pan 12, which is normally attached to the bottom of an internal combustion engine (not shown) to retain a pool of oil for the purpose of lubricating the engine, is shown detached from the engine for the purpose of clarity. A drain hole 14 is positioned in the bottom area of the oil pan 12 to permit the pool of oil to be drained from the oil pan 12 during an oil change. The drain hole 14 extends from an inner surface 16 to an outer surface 18 of the oil pan 12. The drain hole 14 has an insert 20 positioned in the drain hole 14. The insert 20 has threads 22 into which a conventional threaded drain plug (not shown) is threaded, for installation into the oil pan 12, and unthreaded for removal from the oil pan 12. As will be described more fully hereinbelow, the plug 10 is threadless and is therefore not threaded into or out of the insert 20.

A magnetic removal tool 24 is also shown in FIG. 1. The removal tool 24 is magnetically attachable to the plug 10 for the purpose of manually removing the plug 10 from the drain hole 14, in a manner which is described hereinafter.

Referring to FIGS. 2-5, the plug 10 has a disc-shaped magnet 26 with a cylindrical-shaped stem 28 projecting perpendicularly outwardly therefrom. The magnet 26 has a diameter 30 and a centrally located longitudinal axis A-A. The magnet 26 has a flat annular inner surface 32, a flat annular outer surface 34, and a flat cylindrical side surface 36. which extends between the inner and outer surfaces 32, 34. The inner and outer surfaces 32, 34 lie in corresponding planes which are parallel with each other, and are perpendicular to the longitudinal axis A-A of the magnet 26. The magnet 26 has a recess 38 proximate the outer surface 34, and a bore 40 proximate the inner surface 32 (see FIG. 5), for purposes that are described hereinbelow. The magnet 26 is fabricated from grade M-40 permanent magnetic material. The magnet 26 exerts a strong magnetic force vector M (see FIG. 10) on the flat outer surface 18 of the steel oil pan 12, in a manner which is described in greater detail hereinbelow.

A thin flexible disc-shaped gasket 42 has a flat annular inner surface 44, and a flat doughnut-shaped outer surface 46. The inner and outer surfaces 44, 46 lie in corresponding planes which are parallel with each other. The inner surface 44 of the gasket 42 is fastened to the inner surface 32 of the magnet 26 by an adhesive (not shown), although, alternatively, the gasket 42 may not be fastened to the inner surface 32. The adhesive is made from of an oil, fuel, and temperature (i.e., heat and cold) resistant material such as 3M™ Scotch-Weld™ Nitrile High Performance Rubber And Gasket Adhesive 847, or any other suitable material. The outer surface 46 of the gasket 42 is forcibly positioned against the flat outer surface 18 of the oil pan 12 when the plug 10 is fitted thereto, and it conforms to small irregularities on the outer surface 18 of the oil pan 12 in order to seal the drain hole 14 and prevent inadvertent oil leaks. The gasket 42 is made of an oil, fuel, and temperature (i.e., heat and cold) resistant material such as Fluorosilicone Sheeting "DSP50FS" 50 Shore "A" available from Diversified Silicone Products, Inc., or any other suitable material. Alternatively, the inner surface 32 of the magnet 26 may be rubber coated (not shown) with an appropriate oil, fuel, temperature (i.e., heat and cold) resistant material, thereby eliminating the need for a separate gasket, like the gasket 42.

Figure 5:
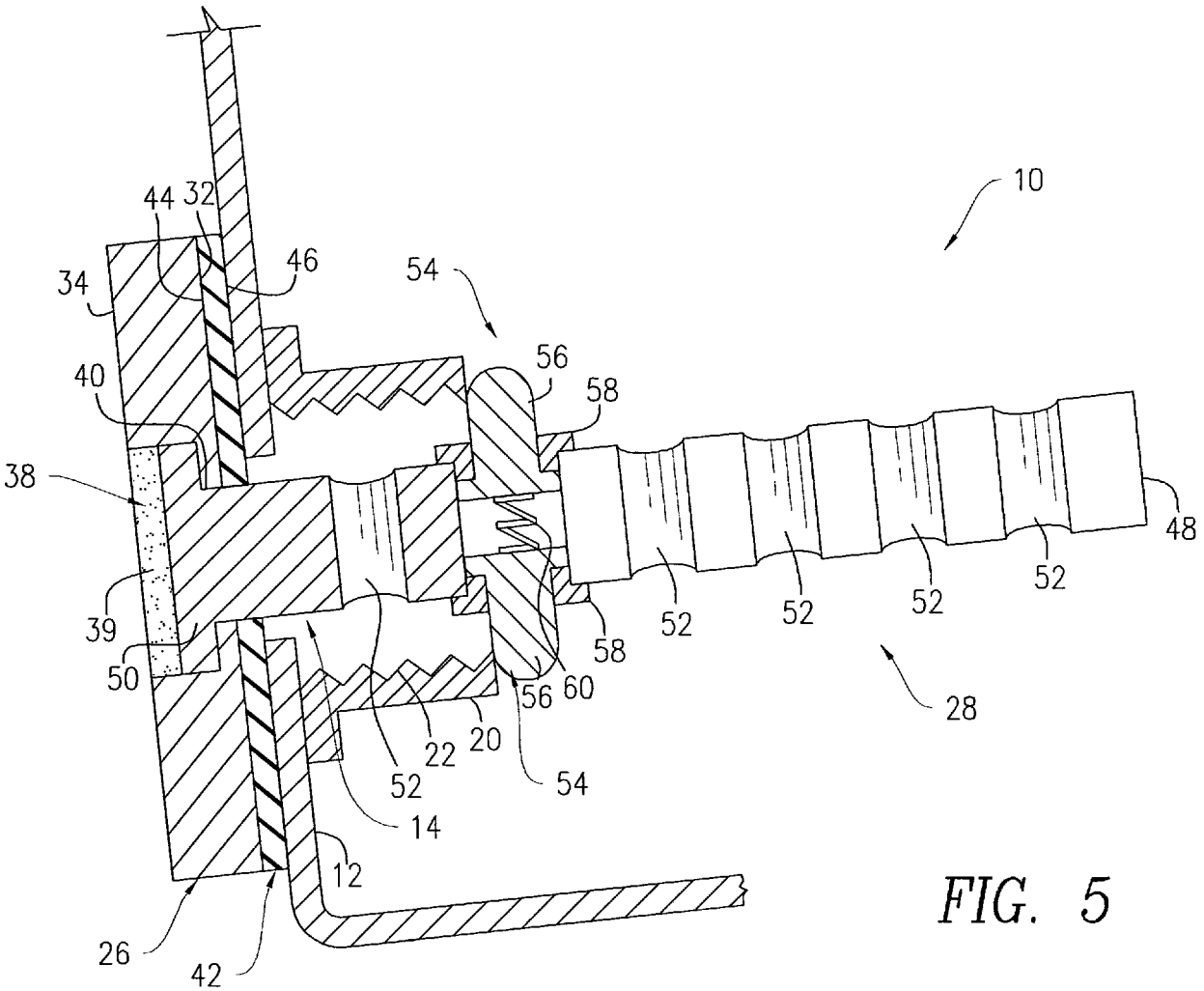
FIG. 5 is a cross-sectional view of the threadless magnetic drain plug taken along the arrow 5-5 of FIG. 3, and looking in the direction of the arrowheads, the threadless magnetic drain plug being shown assembled in the oil pan shown in FIG. 1 as a retrofit replacement for a conventional threaded drain plug (not shown)

Referring to FIG. 5, the stem 28 has an end 48. A head 50 is positioned on the stem 28, opposite the end 48. The stem 28 is press fitted and glued in the magnet 26. More particularly, the stem 28 is press fitted in the bore 40 of the magnet 26, and the head 50 is fixedly fastened and sealed in the recess 38 of the magnet 26 by an adhesive 39 such as Permatex® Black Rubber Sealant S.I.N.: 834-300, or other suitable adhesive. The stem 28 may be fabricated from ferrous metal such as cold finished steel used in the fabrication of clevis pins. The metal should be ferrous in order to conduct a portion of the magnetic field that is exerted by the magnet 26, for purposes that are described hereinafter.

A plurality of through bores 52 is formed in the stem 28. The bores 52 are positioned in the stem 28 to increase or extend the surface area of the stem 28 so that a greater quantity of the harmful metallic particles that are contained in the oil (not shown) becomes magnetically attached to the stem 28, as a result of the magnetic field that extends therethrough. The surface area of the stem 28 may also be extended with fins (not shown) positioned thereon.

A pair of spring plungers 54 is mounted in the stem 28, proximate the magnet 26. Each of the spring plungers 54 has a roundhead plunger 56 which is slideably retained in a collar 58. A spring 60, positioned between the roundhead plungers 56, biases the roundhead plungers 56 away from each other when the collars 58 of the spring plungers 54 are press fitted in the stem 28. The spring plungers 54 are sized and shaped so that when they are press fitted in the stem 28, the outer most transversely oriented tips of the roundhead plungers 56 are separated by a distance that is: i) less than the diameter of the opening of the drain hole 14, when the roundhead plungers 56 are fully compressed; and ii) greater than the diameter of the opening of the drain hole 14, when the roundhead plungers 56 are fully extended by the biasing of the spring 60. Alternatively, semicircular-shaped resilient clips (not shown) that are adapted to function in the manner of the spring plungers 54 may be positioned on the stem 28, thereby eliminating the need for the spring plungers 54.

Figure 6:
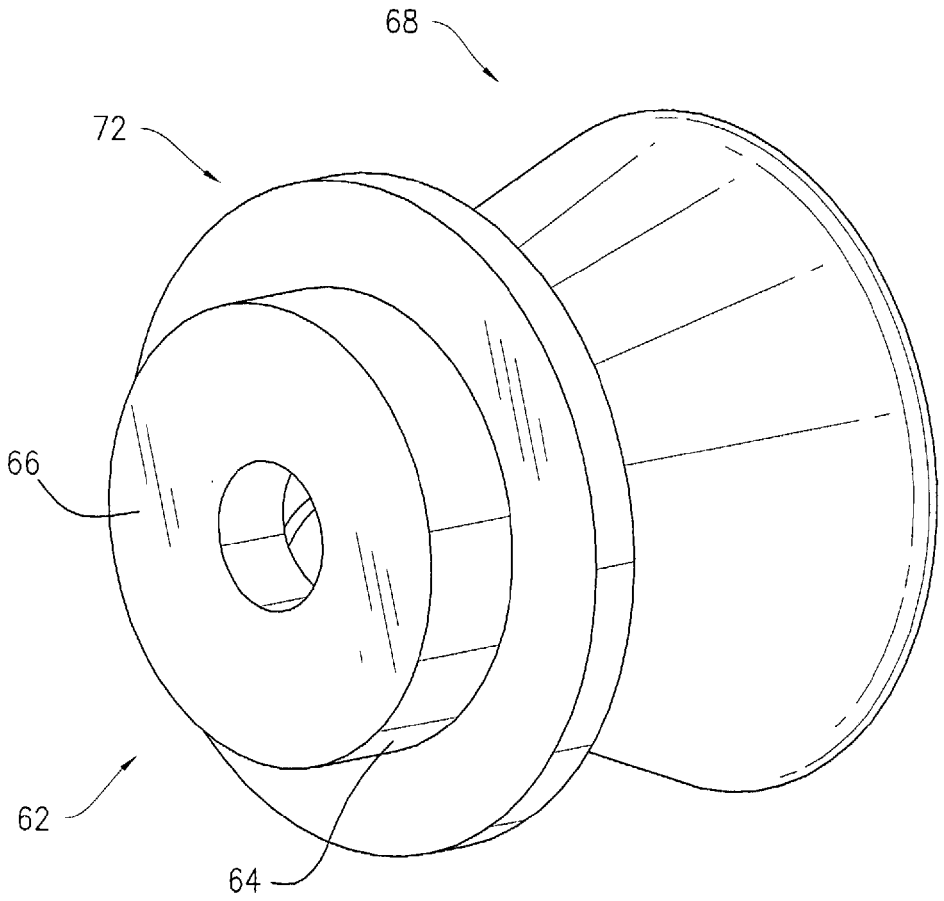
FIG. 6 is a perspective view of the magnetic removal tool shown in FIG. 1.
Figure 7:
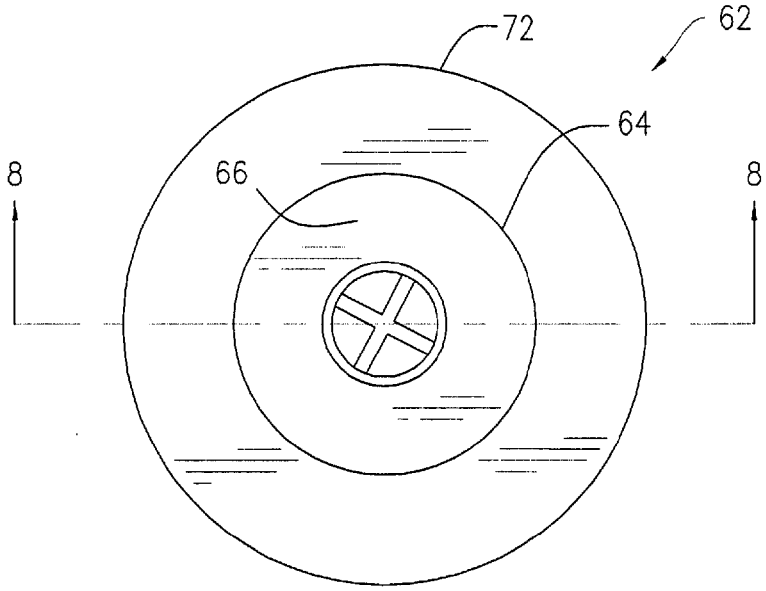
FIG. 7 is a plan view of the magnetic removal tool shown in FIG. 6.
Figure 8:
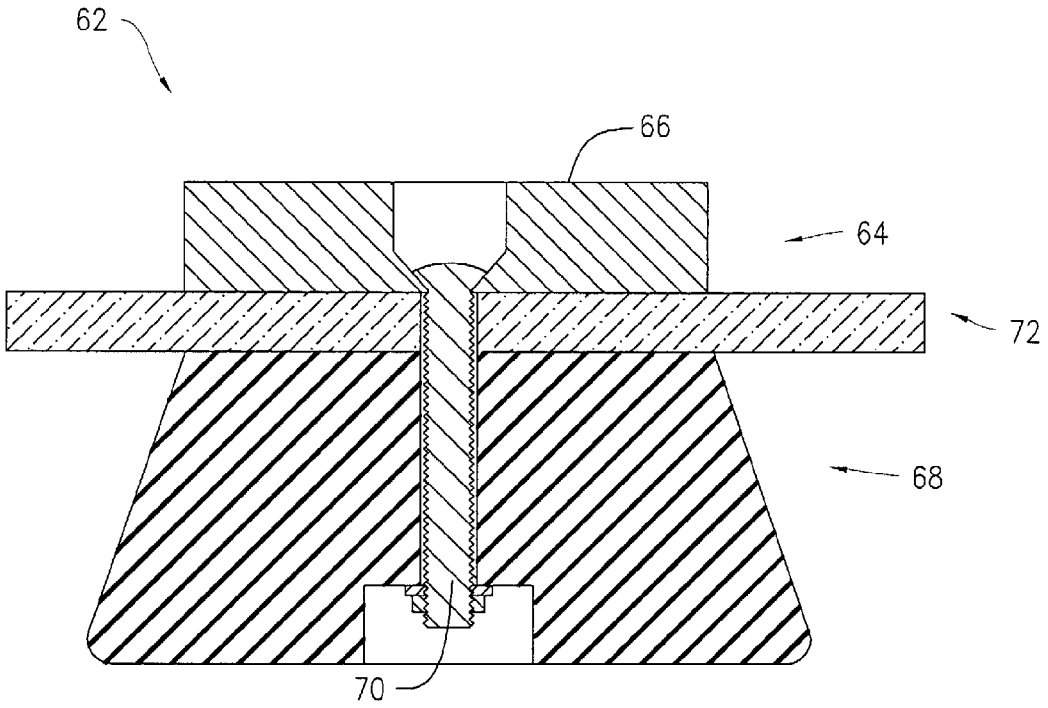
FIG. 8 is a cross-sectional view of the magnetic removal tool shown in FIGS. 6 and 7, taken along the arrow 8-8 of FIG. 7, and looking in the direction of the arrowheads.

Referring now to FIGS. 6-8, a removal tool 62 is depicted which is used to remove the plug 10 from the drain hole 14. The removal tool 62 has a magnet 64 with an outer surface 66, and a hand grip 68 attached to it by a bolt and lock-nut 70. The hand grip 68 is made of pliable rubber in order to permit the hand of the user to readily grasp it. The magnet 64 of the tool 62 is more powerful than the magnet 26 of the plug 10 so that, when the outer surface 66 of the magnet 64 of the removal tool 62 is magnetically attached to the outer surface 34 of the magnet 26 of the plug 10, it remains attached to the plug 10 when the user grasps the hand grip 68 and pulls the plug 10 out of the drain hole 14, in a manner that is described hereinbelow. An annular flexible rubber splash-guard 72 is interposed between the magnet 64 and the hand grip 68 to: i) prevent the fingers of the user from making contact with the hot oil pan, and ii) prevent the drops of hot oil draining out of the drain hole 14 from burning the hand of the user while the stem 28 of the plug 10 is being removed from the drain hole 14 of the oil pan 12.

Figure 9:
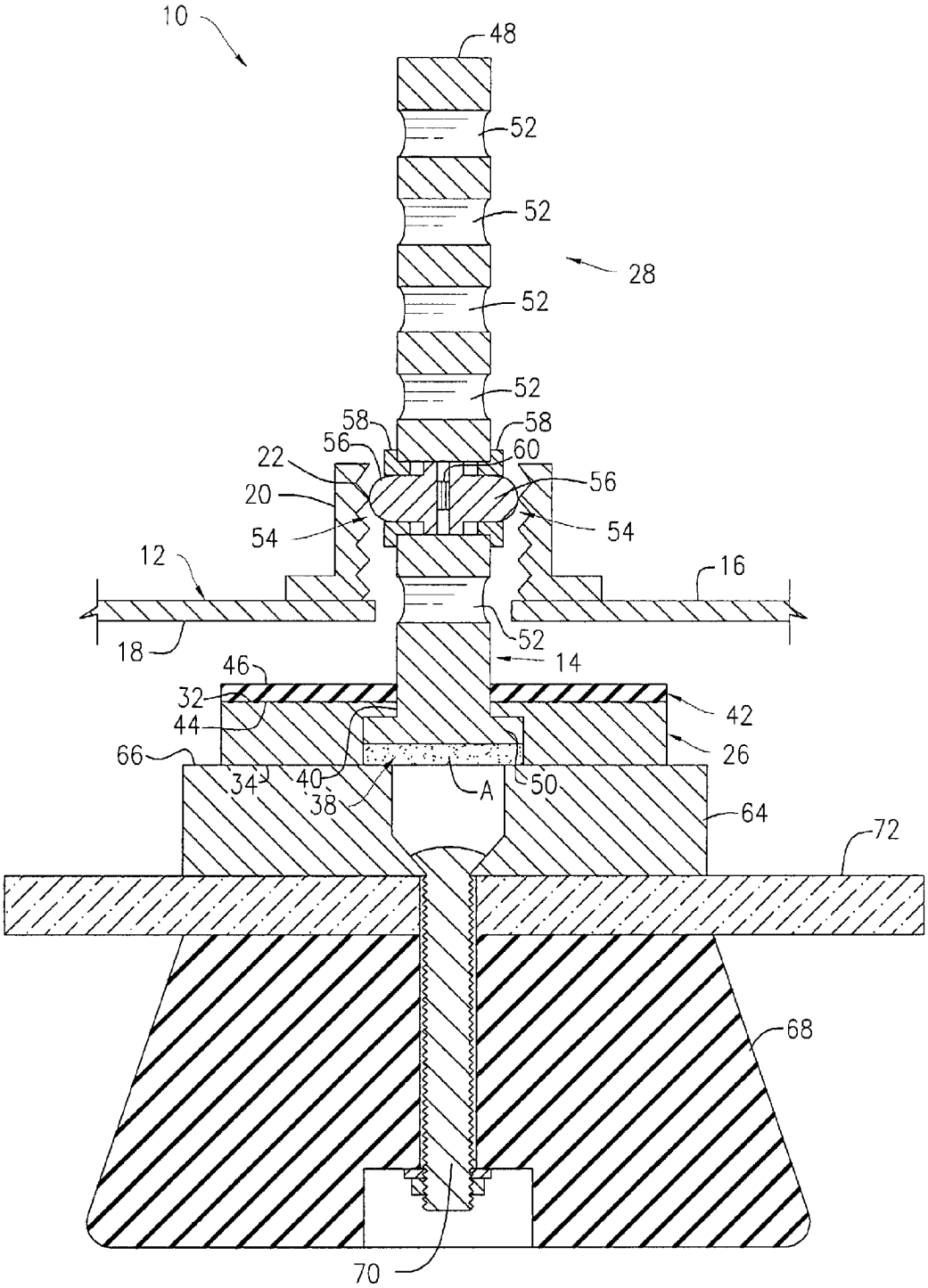
FIG. 9 is a cross-sectional view of the magnetic removal tool shown in FIG. 8 and the threadless magnetic drain plug shown in FIG. 5 during the removal of the magnetic drain plug from the oil pan shown in FIG. 1.

In operation, for example during an oil change, a user (e.g., a mechanic or a lubrication technician) grasps the hand grip 68 of the removal tool 62, and positions the outer surface 66 of the magnet 64 of the removal tool 62 on the outer surface 34 of magnet 26 of the plug 10 so that the removal tool 62 is magnetically fastened to the plug 10. Referring to FIG. 9, as the user pulls the removal tool 62, in a direction of the longitudinal axis A-A of the magnet 26, the surface 46 of the gasket 42 is separated from the outer surface 18 of the oil pan 12, and the roundhead plungers 56 of the spring plungers 54 are compressed radially towards each other by the threads 22 of the insert 20. As the user continues to pull the plug 10, the stem 28 becomes completely removed from the drain hole 14 of the oil pan 12. It is during these steps, in the process of removing the plug 10 from the drain hole 14, that the splash-guard 72 of the removal tool 62 prevents the fingers of the user from making contact with the hot oil pan and deflects drops of hot oil (e.g., that may be at temperatures in the range of 140 to 190 degrees Fahrenheit in a freshly driven engine) away from the hand of the user and into a used-oil receptacle (not shown) that is utilized to collect the oil being drained from the oil pan 12, thereby preventing the user from burning his or her hand.

Once the oil is completely drained out of the oil pan 12, the user then replaces the plug 10 in the drain hole 14 in order to seal it so that fresh oil may be admitted into the oil pan 12. More particularity, the user grasps the magnet 26 of the plug 10 and positions the end 48 of the stem 28 in the drain hole 14. When the roundhead plungers 56 are positioned between the threads 22 of the insert 20, they are compressed. When the plug 10 is fully inserted in the drain hole 14, with the magnet 26 forcibly attracted to the outer surface 18 of the oil pan 12 surrounding the drain hole 14, and the gasket 42 is forcibly seated flush on the outer surface 18 of the pan 12, the roundhead plungers 56 are biased outwardly by the spring 60 to their fully extended position. In their fully extended position, the roundhead plungers 56 press against the interior surface 16 of the oil pan 12 proximate the drain hole 14 (see FIG. 5). In this position, the spring plungers 54 provide a locking mechanism which locks the plug 10 sealably in place, even in the rare event when the magnetic field of the magnet 26 is diminished or reduced to zero, it being understood that the magnet 26 is rarely exposed to conditions that may diminish or reduce its magnetic force to zero during normal operation of the motor vehicle. In this position, the spring plungers 54 also perform a tamper resistant function. It should be understood that, in the absence of the spring plungers 54, the plug 10 magnetically and forcibly seals the drain hole 14 from oil leaks during all phases of operation of the motor vehicle engine on which the oil pan 12 and the plug 10 are attached. To illustrate this, force vector analyses are provided below.

Figure 10:
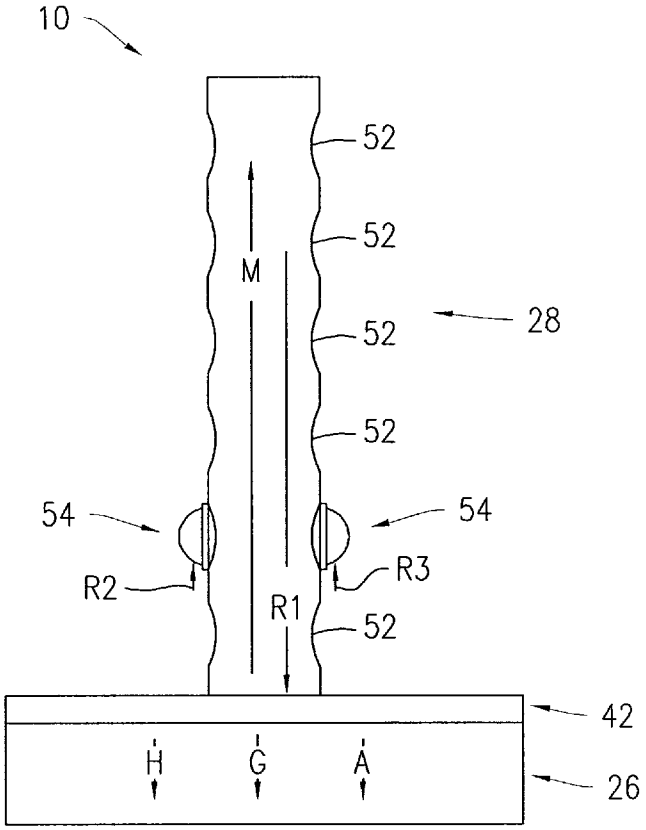
FIG. 10 is a free-body-diagram which depicts force vectors acting on the threadless magnetic drain plug shown in FIG. 5, and in which a predominant force vector is a magnetic force M.

FIG. 10 depicts components of the force vectors acting on the plug 10 in the direction of the longitudinal axis A-A. The components of the force vectors acting on the plug 10 in the transverse direction (i.e., acting perpendicularly to the axis A-A) are not shown since these components are offset by reactive force vectors such as those created by the friction of the outer surface 46 of the gasket 42 acting on the outer surface 18 of the oil pan 12. The components of the force vectors acting on the plug 10 in the direction of the longitudinal axis A-A are:

- M, a magnetic attractive force exerted by the magnet 26;
- G, a force exerted by gravity;
- H, a force exerted by the hydrostatic head of the reservoir of oil in the oil pan 12;
- A, a variable force exerted by the acceleration of the oil in the oil pan due to the motion of the oil in the oil pan 12 during operation of the motor vehicle;
- R1, a reactive force exerted by the oil pan 12, in reaction to M; and
- R2 and R3, reactive forces exerted by the oil pan 12, in reaction to the roundhead plungers 56.

Since the plug 10 is in a static condition (i.e., it is not moving in relationship to the drain hole 14 of the oil pan 12), the sum of the force vectors acting on the plug 10 in the direction of the longitudinal axis A-A must be equal to zero, or M+R2+R3−R1−G−H−A=0

Figure 11:
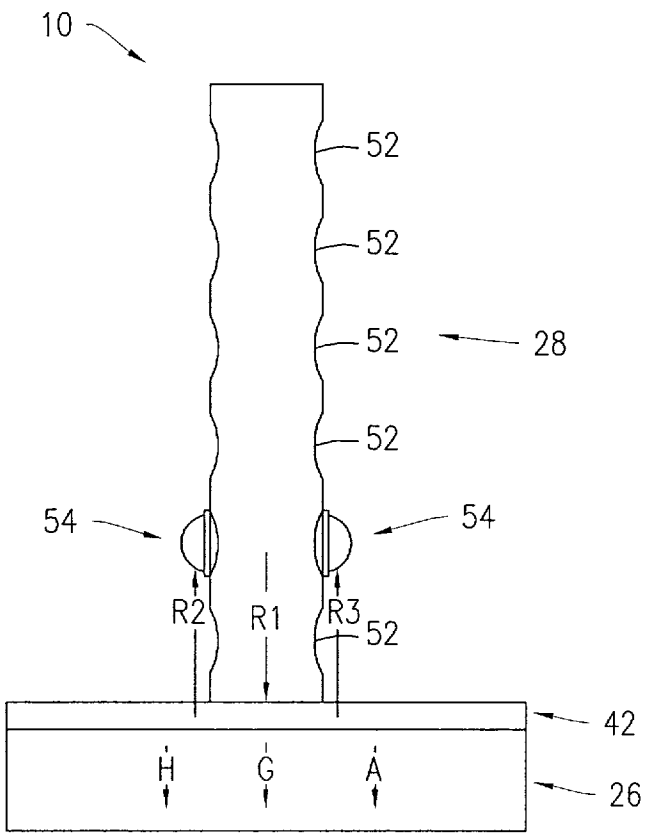
FIG. 11 is free-body-diagram which depicts force vectors acting on the threadless magnetic drain plug shown in FIG. 5, and in which the magnetic force M has a zero value and is therefore not shown.

FIG. 11 depicts components of the force vectors acting on the plug 10 in the direction of the longitudinal axis A-A in the very rare instance when the magnetic force vector M of the magnet 26 may be diminished to zero, for example, in instances in which the magnet 26 is repeatedly subjected to temperatures greater than about 225 degrees Fahrenheit. It should be understood that the highest temperature normally encountered in the operation of an internal combustion engine is about 190 degrees Fahrenheit. Since the plug 10 is in a static condition (i.e., it is not moving in relationship to the drain hole 14 of the oil pan 12), the sum of the force vectors acting on the plug 10 in the direction of the longitudinal axis A-A must be equal to zero, or R2+R3−R1−G−H−A=0. In this instance, the spring plungers 54 provide the fail safe locking mechanism that locks the plug 10 sealingly in place in the drain hole 14 of the oil pan 12.

Figure 12:
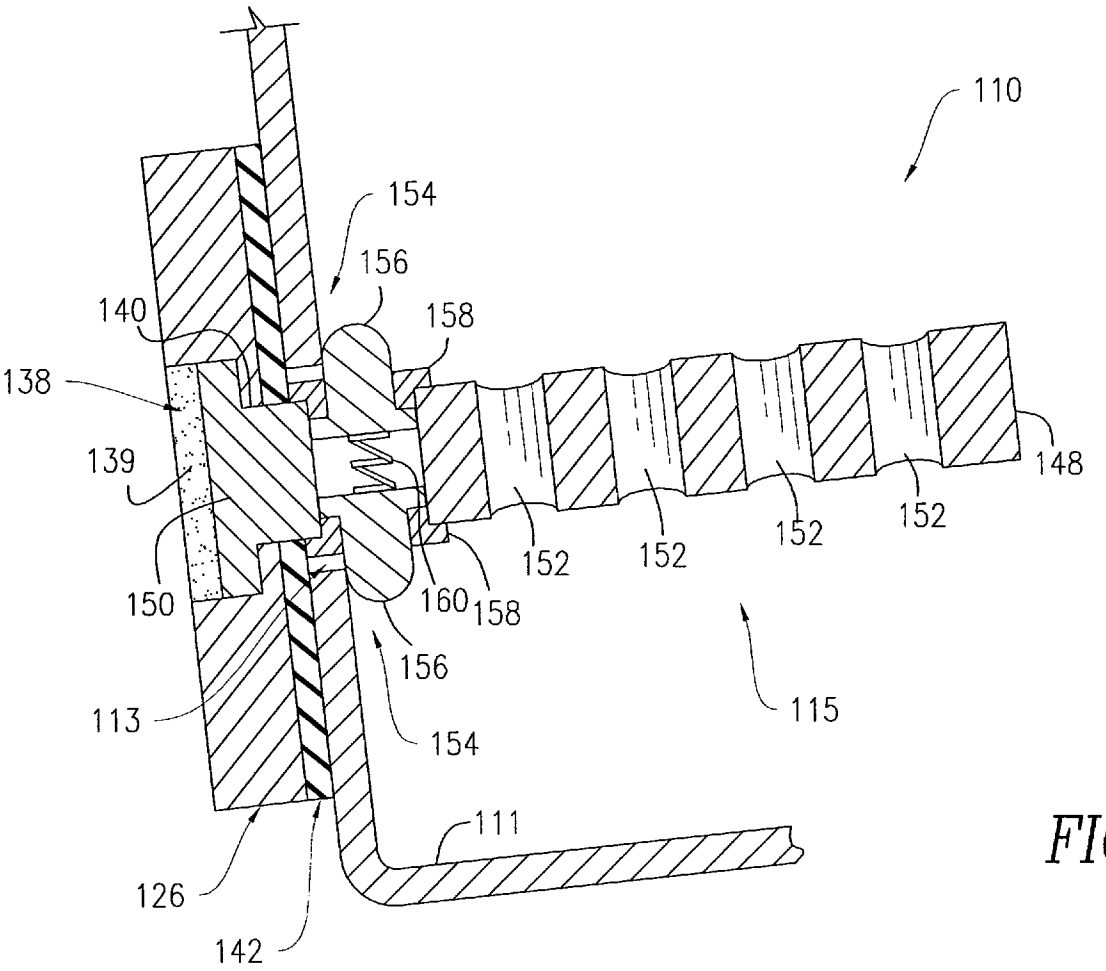
FIG. 12 is a cross-sectional view of a threadless magnetic drain plug, similar to the drain plug shown in FIGS. 1-5, constructed in accordance with a second embodiment of the present invention, the threadless magnetic drain plug being shown assembled in an oil pan which does not have a threaded insert.

FIG. 12 depicts a second embodiment of the present invention. Elements illustrated in FIG. 12 which correspond, either identically or substantially, to the elements described above with respect to the embodiment of FIGS. 1-5 have been designated by corresponding reference numerals increased by one hundred. Unless otherwise stated, the embodiment of FIG. 12 is constructed and assembled in the same basic manner as the embodiment of FIGS. 1-5.

FIG. 12 illustrates a threadless magnetic oil drain plug (hereinafter "the plug 110") constructed in accordance with an second embodiment of the present invention. The plug 110 is similar to the plug 10, except, as will be described in greater detail hereinbelow, the plug 110 has one fewer through bore in the stem and the spring plungers are positioned closer to the head of the stem. A portion of an oil pan 111 is shown surrounding a drain hole 113 which does not have an a threaded insert positioned therein. The oil pan 111 is designed specifically for use with the oil plug 110 and is therefore manufactured without an insert provisioned in the drain hole 113, because the threadless plug 110 does not depend on a threaded insert. The plug 110 has a magnet 126 with a gasket 142 fastened to it. A stem 115 with a head 150 extends perpendicularly from the magnet 126. A plurality of through bores 152 is positioned in the stem 115, and a pair of spring plungers 154 is press fitted in the stem 115. The plug 110 magnetically seals the drain hole 113 of the oil pan 111 from oil leaks, in the manner described hereinabove in relation to the plug 10 of the embodiment of FIGS. 1-5. The spring plungers 154 provide a fail safe locking mechanism that locks the plug 110 sealingly in place in the drain hole 113 of the oil pan 111.

Figure 13:
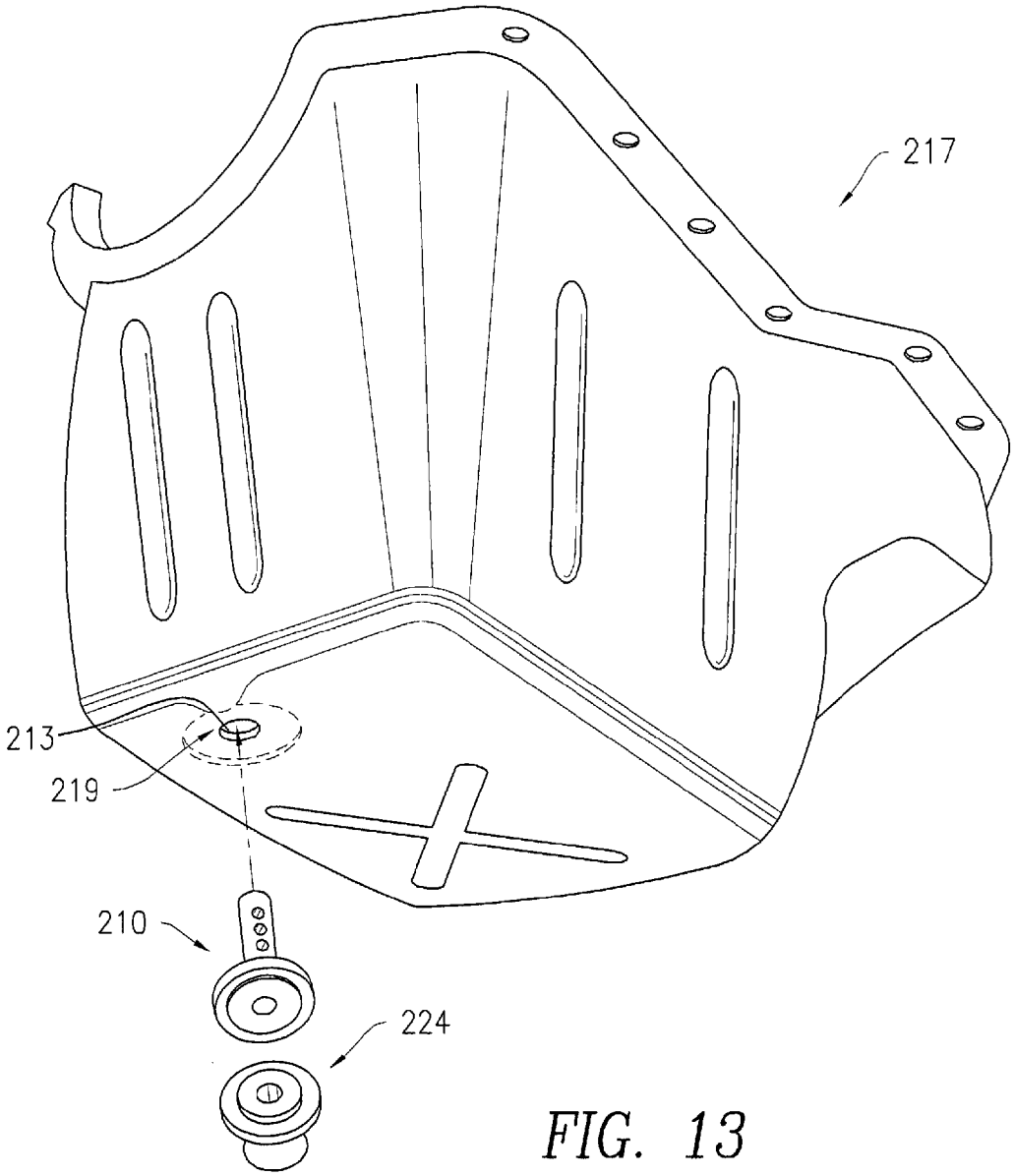
FIG. 13 is a perspective view of a threadless magnetic oil drain plug and a magnetic removal tool constructed in accordance with a third embodiment of the present invention, the threadless magnetic drain plug and the magnetic removal tool being shown positioned externally to an oil pan having a drain hole located in an U-shaped depression formed on the bottom of the oil pan.
Figure 14A:
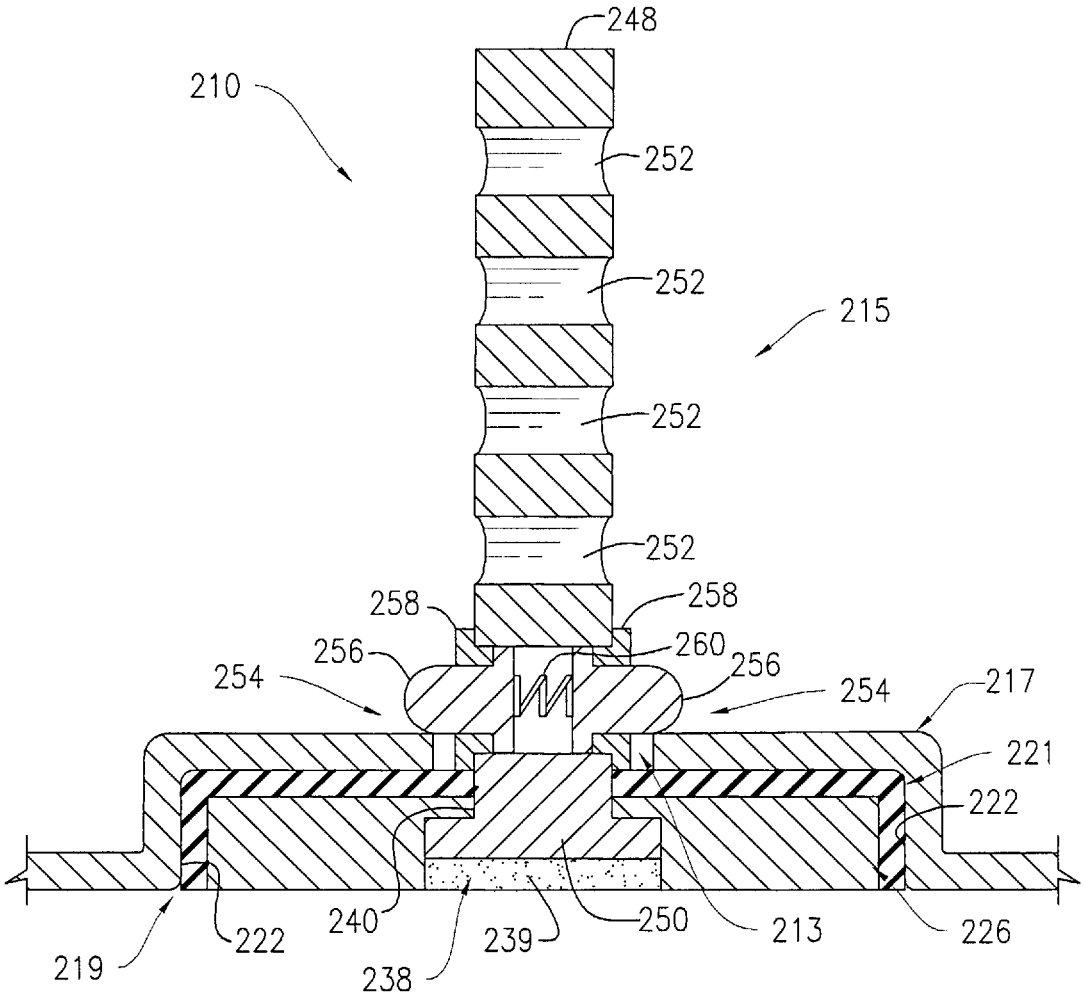
FIG. 14A is a cross-sectional view of the threadless magnetic oil drain plug shown in FIG. 13, the threadless magnetic drain plug being shown assembled in the U-shaped depression of the oil pan shown in FIG. 13.
Figure 14B:
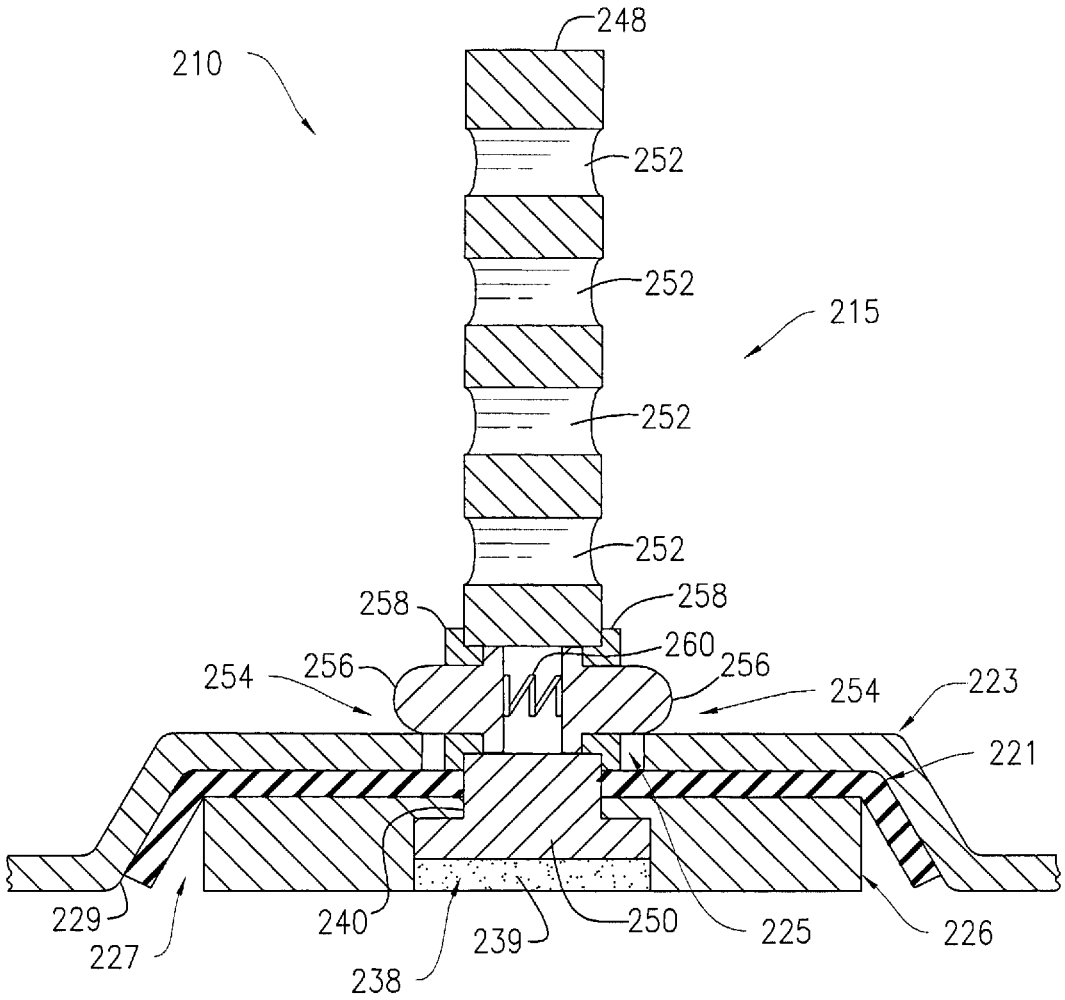
FIG. 14B is a cross-sectional view of the threadless magnetic oil drain plug shown in FIG. 13, the threadless magnetic drain plug being shown assembled in an oil drain hole located in an alternatively shaped depression formed on the bottom of the oil pan shown in FIG. 13.

FIGS. 13-14B depict a third embodiment of the present invention. Elements illustrated in FIGS. 13-14B which correspond, either identically or substantially, to the elements described above with respect to the embodiment of FIG. 12 have been designated by corresponding reference numerals increased by two hundred. Unless otherwise stated, the embodiment of FIGS. 13-14B is constructed and assembled in the same basic manner as the embodiment of FIG. 12.

FIGS. 13-14B illustrate a threadless magnetic oil drain plug (hereinafter "the plug 210") constructed in accordance with a third embodiment of the present invention. The plug 210 is similar to the plug 110, except the plug 210 has a larger gasket than the 110 plug, as will be described in greater detail hereinbelow.

Referring specifically to FIG. 13, an oil pan 217 is shown which has a drain hole 213 centrally positioned in an U-shaped depression 219 in the bottom of the oil pan 217. The oil pan 217 is designed specifically for use with the oil plug 210 and is therefore manufactured without an insert provisioned in the drain hole 213, because the threadless plug 210 does not depend on a threaded insert.

Referring to FIG. 14A, the plug 210 is shown installed in the U-shaped depression 219 of the oil pan 217. The plug 210 has a magnet 226 with a flexible gasket 221 fastened to it. The gasket 221 is manufactured with a diameter that is larger than the diameter of the plug 210 so that it extends radially beyond the circumferential perimeter of the magnet 226, thereby enhancing the sealing capabilities of the gasket 221. A stem 215 with a head 250 extends perpendicularly from the center of the magnet 226. A plurality of through bores 252 is positioned in the stem 215, and a pair of spring plungers 254 is press fitted in the stem 215. The plug 210 magnetically seals the drain hole 213 of the oil pan 217 from oil leaks, in the manner described hereinabove in relation to the plug 10 of the embodiment of FIGS. 1-5. The spring plungers 254 provide a fail safe locking mechanism that locks the plug 210 sealingly in place in the drain hole 213 of the oil pan 217, in the unlikely event that magnetism of the magnet 226 becomes diminished or zero, it being understood that the magnet 226 is rarely exposed to conditions that may diminish or reduce its magnetic force to zero during normal operation of the motor vehicle. In this position, the spring plungers 254 perform a tamper-resistant function.

The depression 219 is formed with a cylindrical shaped wall 222 that is perpendicularly oriented relative to the bottom of the oil pan 217. The depression 219 also has a depth which is substantially equal to the thickness of the magnet 226 plus the thickness of the gasket 221. The exterior form of the depression 219 provides an area in which the position of the installed plug 210 is: i) centered relative to the center of the drain hole 213; and ii) shielded from objects (e.g., rocks, curbs, tree stumps, etc.) that may pass closely by the bottom surface of the oil pan 217, and which may damage or dislodge the plug 210 from the drain hole 213 during operation of an associated motor vehicle. The form of the depression 219 of the oil pan 217 may have various configurations. For instance, another configuration is described below.

FIG. 14B depicts the plug 210 positioned in an oil pan 223 that has a drain hole 225 that is centered in a depression 227. The depression 227 is formed with a wall 229 that is obliquely oriented relative to the bottom of the oil pan 223. The depression 227 has a depth that is substantially equal to the thickness of the magnet 226 plus the thickness of the gasket 221. In this configuration, the depression 227 also provides an area in which the position of the plug 210 is: i) centered relative to the center of the drain hole 225; and ii) shielded from objects that pass by the bottom surface of the oil pan 223 and which may damage or dislodge the plug 210 from the drain hole 225 during operation of an associated motor vehicle.

Figure 15:
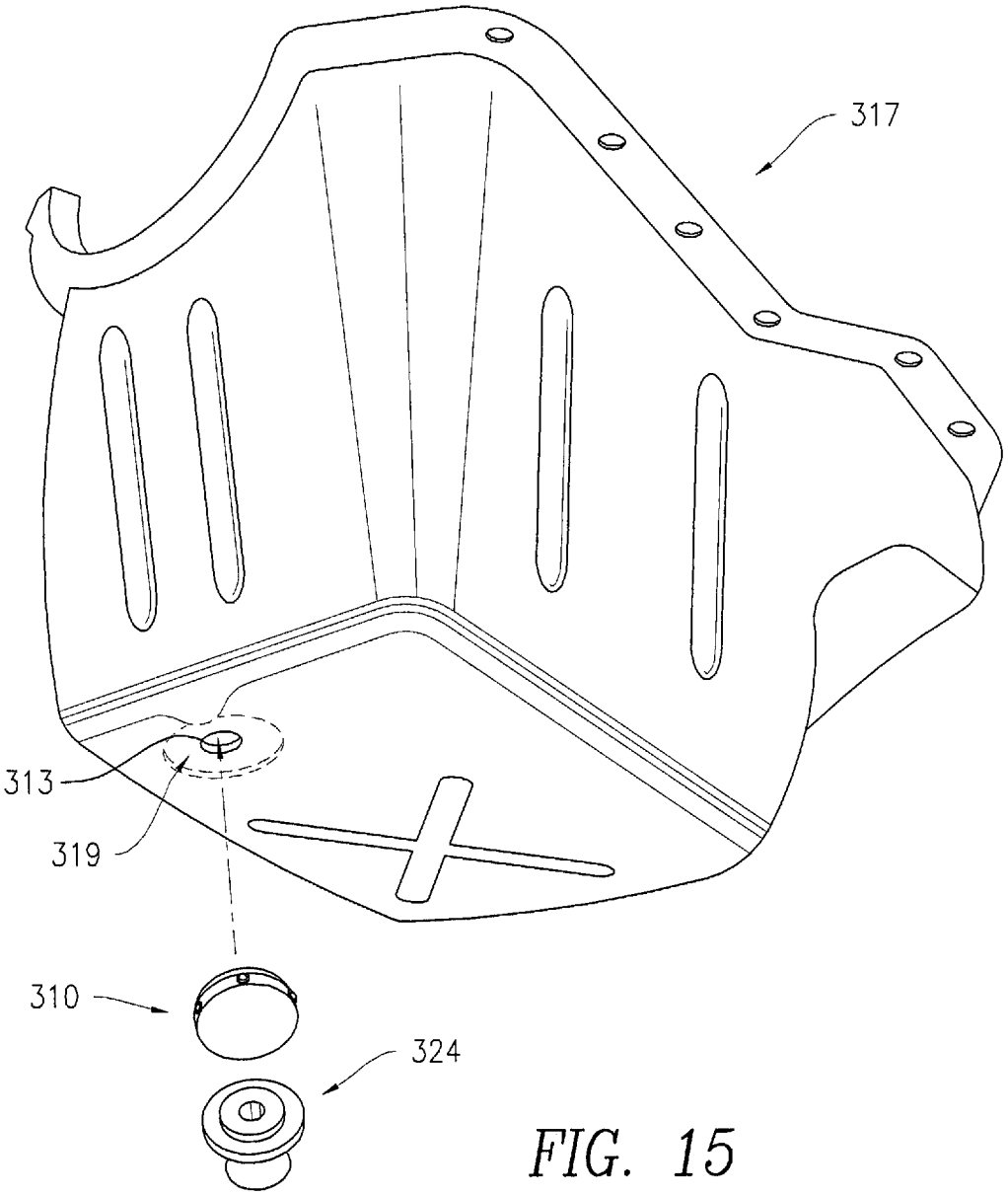
FIG. 15 is a perspective view of a threadless magnetic oil drain plug and a magnetic removal tool constructed in accordance with a fourth embodiment of the present invention, the threadless magnetic drain plug and the magnetic removal tool being shown positioned externally to an oil pan having a drain hole located in an U-shaped depression formed on the bottom of the oil pan.
Figure 16:
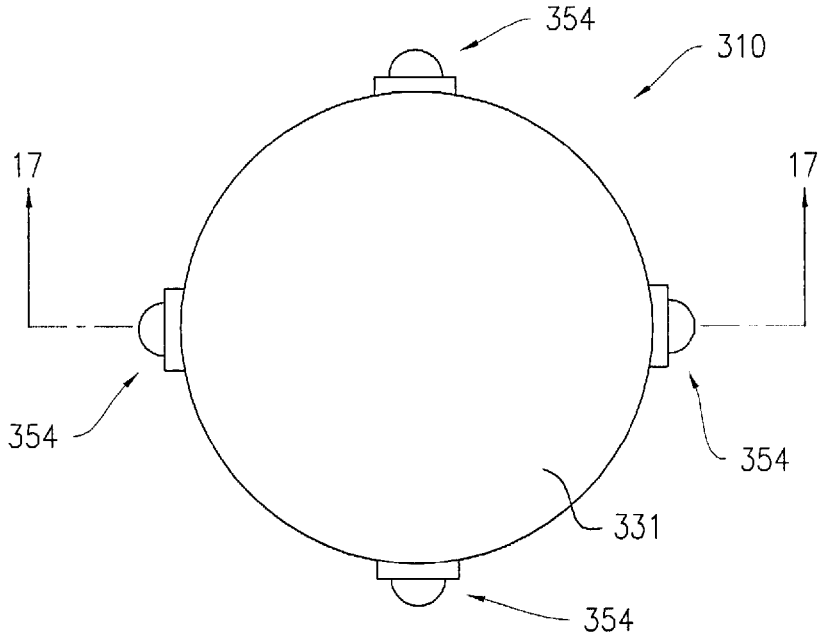
FIG. 16 is a plan view of the threadless magnetic drain plug shown in FIG. 15.
Figure 17:
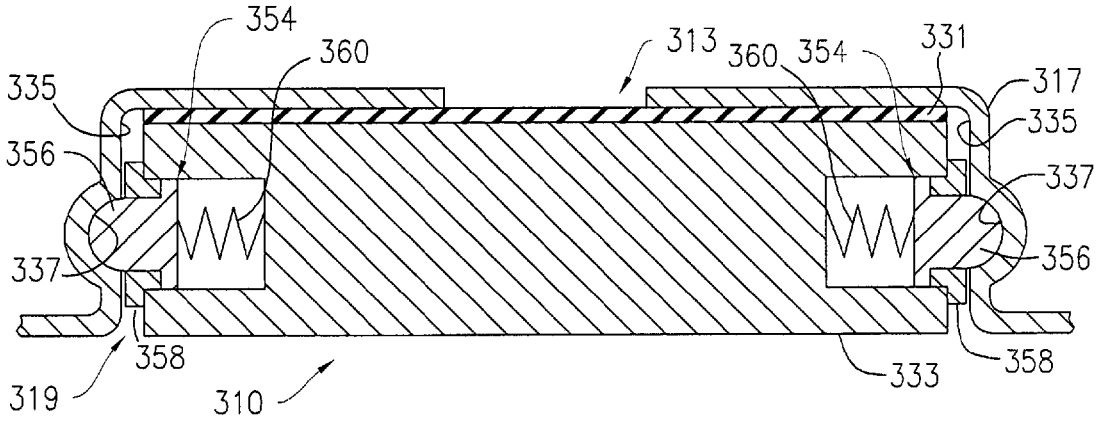
FIG. 17 is a cross-sectional view of the threadless magnetic drain plug shown in FIG. 16, taken along the arrow 17-17 of FIG. 16, and looking in the direction of the arrowheads, the threadless magnetic drain plug being shown assembled in the oil pan shown in FIG. 15.

FIGS. 15-17 depict a forth embodiment of the present invention. Elements illustrated in FIGS. 15-17 which correspond, either identically or substantially, to the elements described above with respect to the embodiment of FIGS. 13-14B have been designated by corresponding reference numerals increased by three hundred. Unless otherwise stated, the embodiment of FIGS. 15-17 is constructed and assembled in the same basic manner as the embodiment of FIGS. 13-14B.

FIGS. 15-17 illustrate a threadless magnetic oil drain plug (hereinafter "the plug 310") constructed in accordance with a fourth embodiment of the present invention. An oil pan 317 has a drain hole 313 centrally located in a depression 319 formed in the bottom of the oil pan 317. The oil pan 317 is designed specifically for use with the oil plug 310 and is therefore manufactured without an insert provisioned in the drain hole 313, because the threadless plug 310 does not depend on a threaded insert for sealing the drain hole 313. The plug 310 has a gasket 331 attached to a magnet 333, however it does not have a stem. The plug 310 therefore lacks the inherent centering capability of a stem for centering the magnet 333 around the drain hole 313 while the plug 310 is being installed on the drain hole 313. The depression 319 supplants the centering capability provided by a stem, as is shown in FIG. 17

FIG. 16 illustrates the placement of four spring plungers 354 in the magnet 333 of the plug 310, for purposes described hereinbelow. Alternatively, two, three, or more than four spring plungers 354 may be positioned in the magnet 333, depending on the size of the oil pan 317 and/or the drain hole 313.

Referring to FIG. 17, each of the spring plungers 354 has a roundhead plunger 356 that is slidably positioned within a collar 358. Each collar 358 is press-fitted in the magnet 333, thereby securing each spring plunger 354 in the magnet 333. Each roundhead plunger 356 is constantly urged radially outward from (i.e., in a direction generally perpendicular to the longitudinal axis of the plug 310) by the spring 360. Likewise, each roundhead plunger 356 is free to be compressed radially inward, for instance during the insertion of the plug 310 into the depression 319 of the oil pan 317, in a manner which is described hereinbelow. Alternatively, semi-circular-shaped resilient clips (not shown) that are adapted to function in the manner of the spring plungers 354 may be positioned on the magnet 333, thereby eliminating the need for the spring plungers 354.

Referring to FIG. 17, the plug 310 is shown installed in the U-shaped depression 319 of the oil pan 317. The plug 310 magnetically seals the drain hole 313 of the oil pan 317 from oil leaks in the manner described hereinabove in relation to the plug 10 of the embodiment of FIGS. 1-5. The spring plungers 354 provide a fail safe locking mechanism that locks the plug 310 sealingly in place in the depression 319 of the oil pan 317 in the unlikely event that the magnetic force exerted by the magnet 333 becomes diminished or even zero, it being understood that the magnet 333 is rarely exposed to conditions that may diminish or reduce its magnetic force to zero during normal operation of the motor vehicle. In this position, the spring plungers 354 perform a tamper resistant function. More particularly, the depression 319 has a cylindrical wall 335 that is generally perpendicular to the bottom of the oil pan 317, and which causes the depression 319 to have a depth that is substantially equal to the thickness of the magnet 333 plus the thickness of the gasket 331. The wall 335 of the depression 319 also has a circumferentially-oriented, cup-shaped groove 337. The groove 337 acts as a detent for accepting or seating all of the roundhead plungers 356 therein, when the plug 310 is fully inserted in the depression 319. When the roundhead plungers 356 are all seated in the groove 337, the roundhead plungers 356 exert force vectors (not shown) directed in direction of the longitudinal axis of the drain hole 313 which react to offset the force vectors (not shown) that are acting to dislodge the plug 310 from the depression 319.

The depression 319 of the oil pan 317 provides an area in which the position of the plug 310 is: i) centered relative to the center of the drain hole 313; ii) shielded from objects that may closely pass by the bottom surface of the oil pan 317 and which may therefore damage the plug 310 or dislodge it from the drain hole 313; and iii) secured in the groove 337.

It should be appreciated that the present invention provides numerous advantages over the prior art discussed above. For instance, the plug 10 provides a safe and inexpensive means for the repair of worn or cross-threaded threads 22 of the insert 20 of the oil pan 12, which otherwise would have to be replaced with an entire new or refurbished oil pan 12. In addition, the plug 10 reduces the time interval for performing an oil change since the removal and installation processes include one swift motion on behalf of the user, as opposed to the user using a wrench to unscrew and screw a conventional threaded plug out of and into the threads 22 of the insert 20 of the oil pan 12. The removal tool 62 also provides a splash guard 72 for diverting hot oil from the hand of the user when performing the oil change. Since the plug 10 is threadless, it may also be used as a retrofit to replace a conventional drain plug which may have damaged threads and/or overcome the use of damaged threads 22 of the insert 20 of an oil pan 12. Because the plug 10 does not have threads, it can not be accidentally "backed out" of the oil pan 12 (i.e., become unscrewed and fall out of the oil pan 12 in instances when the wear on the threads 22 of the insert 20 and the threads of the conventional drain plug (not shown) reaches a point where the conventional drain plug is no longer able to be screwed into in the drain hole 14 without it leaking, or the conventional drain plug becomes completely unscrewed from the drain hole 14 by the vibrations of the oil pan during the operation of the engine. Because the plug 10 can not be accidentally "back out" of the oil pan 12, the possibility of an accidental oil spill that may create an adverse impact on the environment, a safety hazard for slipping or falling, and damage to the engine is also eliminated. Also, the threads 22 of the insert 20 of the oil pan 12 can not be damaged by the operation of the plug 10. The plug 10 is also tamper resistant because, without the use of the removal tool, an unauthorized person can not readily remove the plug 10 from the oil pan 12, using for example a screwdriver, due to the forces exerted on the plug 10 by the magnet 26 and the spring plungers 54. Since the plug 110 is threadless, it permits the oil pan 111 original equipment manufacture (OEM) the ability to eliminate the costly fabrication and installation processes related to the provisioning of a threaded insert in the oil pan 111, thereby significantly reducing the OEM's manufacturing costs related to the production of the oil pan 111.

It should be noted that the present invention can have numerous modifications and variations. For instance, in the event that an oil pan is fabricated out of a nonferrous material, such as aluminum, which is not affected by the magnetic field of the magnet 26, then the magnet 26 of the plug 10 will not be effective in locking the plug 10 in the drain hole of such an oil pan. Although the spring plungers 54 will be effective in locking the plug 10 in the drain hole of such an oil pan, it may be preferential to also have the magnetic field of the magnet 26 effectively lock the plug 10 in the drain hole of such an oil pan. In order to utilize the plug 10 on a non-ferrous oil pan with these capabilities, an adaptive appliance may be fitted to the non-ferrous oil pan. Such an adaptive appliance is described below, in relation to FIGS. 18-20.

Figure 18:
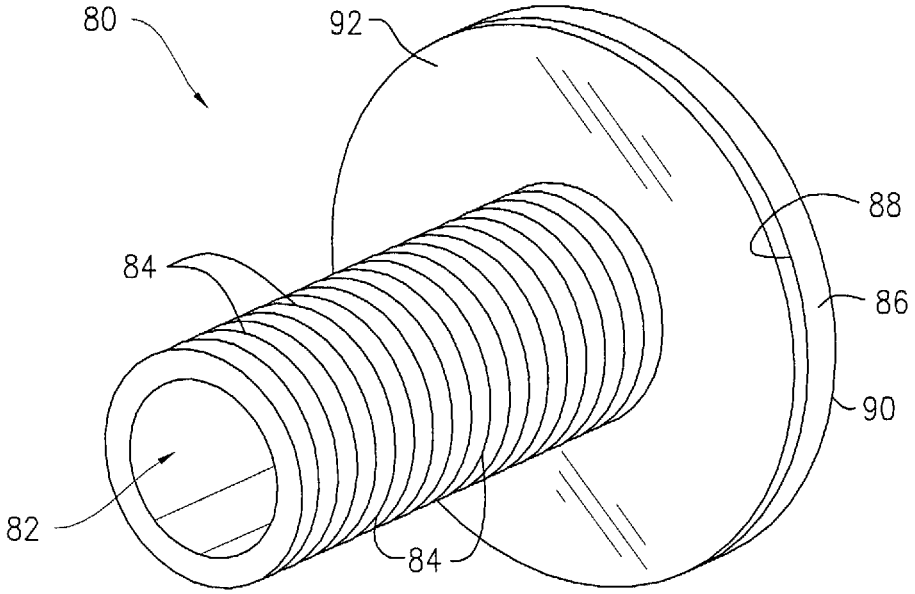
FIG. 18 a perspective view of a T-shaped steel bolt with a hollow core for use in retrofitting the threadless magnetic drain plug shown in FIGS. 1-5 to a non-ferrous oil pan.
Figure 19:
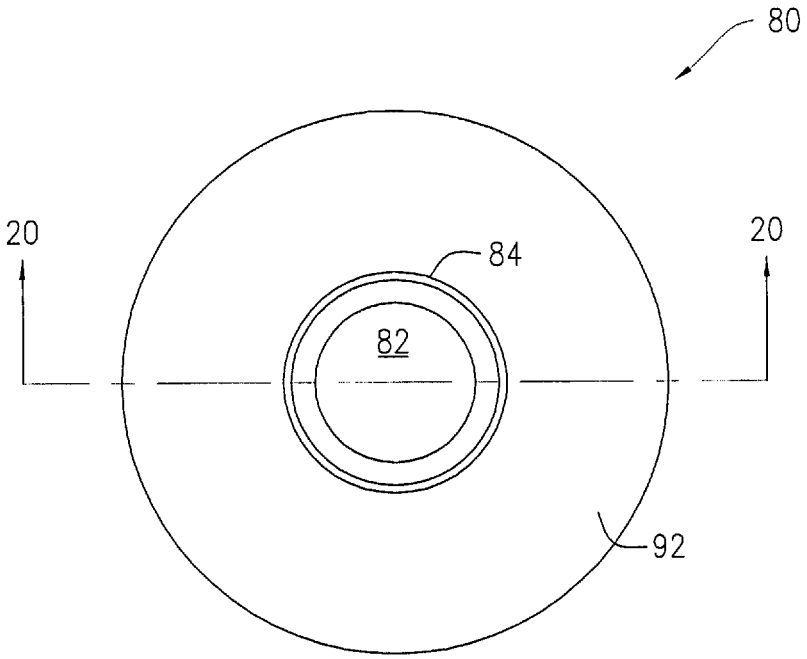
FIG. 19 is a plan view of the T-shaped steel bolt shown in FIG. 18.
Figure 20:
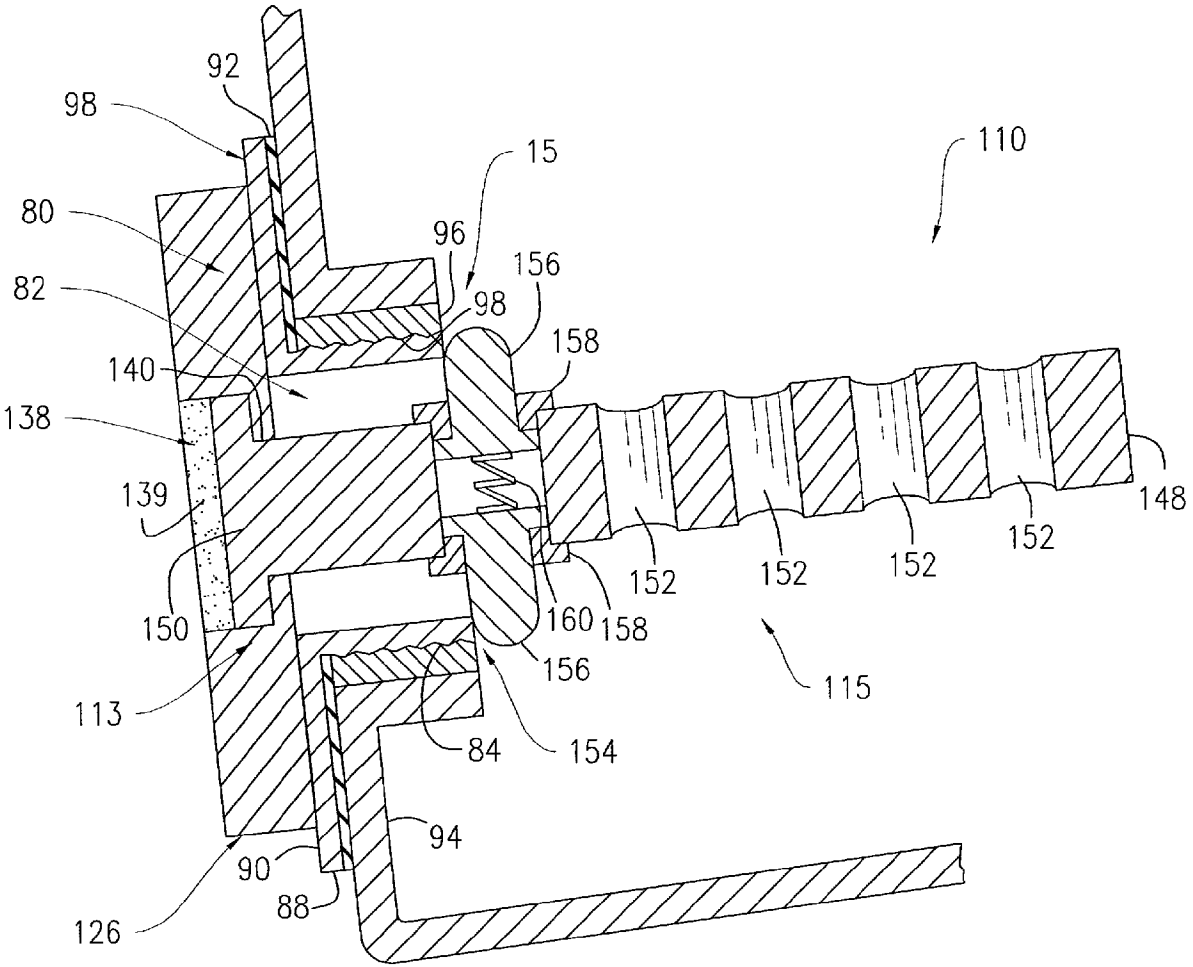
FIG. 20 is a cross-sectional view of the T-shaped steel bolt shown in FIG. 19, taken along the arrow 20-20 of FIG. 19, and looking in the direction of the arrowheads, the T-shaped steel bolt being shown in combination with the threadless magnetic drain plug of FIGS. 1-5 and with a non-ferrous oil pan.

FIGS. 18-20 depict a T-shaped steel bolt 80. The bolt 80 has a hollow cylindrical-shaped internal channel 82, a set of external or reverse threads 84, and a flat head 86. The head 86 has an inner surface 88 and an outer surface 90. A gasket 92 is positioned on the inner surface 88 of the head 86, for purposes that are described hereinafter. The gasket 92 is fastened to the inner surface 88 of the head 86 by an adhesive (not shown). The adhesive is made from of an oil, fuel, and temperature (i.e., heat and cold) resistant material such as 3M™ Scotch-Weld™ Nitrile High Performance Rubber And Gasket Adhesive 847, or any other any suitable material. The gasket 92 is likewise made of an oil, fuel, and temperature (i.e., heat and cold) resistant material such as Fluorosilicone Sheeting "DSP50FS" 50 Shore "A" available from Diversified Silicone Products, Inc., or any other suitable material.

Referring specifically to FIG. 20, the steel bolt 80 is shown positioned in a non-ferrous oil pan 94 which has an insert 96 with internal threads 98. The steel bolt 80 adapts the non-ferrous oil pan 94 for use with the plug 10. More particularly, the external threads 84 of the steel bolt 80 are screwed into the internal threads 98 of the insert 96 so that the gasket 92 is compressed against the oil pan 94, thereby sealing the bolt 80 from oil leaks (i.e., other than through the channel 82). The stem 28 of the plug 10 is installed and removed through the channel 82, in the manner described hereinabove with respect to the embodiment of FIGS. 1-5. Because the bolt 80 is made of steel, the magnet 26 of the plug 10 magnetically and forcibly seals the gasket 42 of the plug 10 on the outer surface 90 of the head 86 of the bolt 80.

To reiterate, the present invention overcomes the disadvantages and shortcomings of the prior art by providing a threadless magnetic oil drain plug which completely eliminates the need for the threads of the conventional threaded drain plug. More particularly, the plug has a powerful permanent magnet which is used to stop-up or seal-off the drain hole of the oil pan. The magnetic force of the magnet attracts the magnet to the oil pan where it strongly adheres to the outer surface of the oil pan and seals the drain hole with a gasket. A cylindrical-shaped stem projects perpendicularly from the center of one side of the magnet. The stem has a diameter that is smaller than the diameter of the drain hole and, when it is inserted in the drain hole, acts as a guide for positioning the magnet centrally around the opening of the drain hole. A pair of opposed spring plungers are mounted in the stem. The spring plungers are sized, shaped and positioned in the stem such that as the stem is inserted in the drain hole, they are compressed radially towards each other, thereby permitting the stem to be inserted in the drain hole, and when the stem is fully inserted in the drain hole, the spring plungers expand radially outward, thereby locking the plug in its sealed-off position in the drain hole.

A removal tool is used to remove the plug from the drain hole. The tool has a magnet with a hand grip attached to it. The magnet of the tool is more powerful than the magnet of the plug, so that when the tool is magnetically attached to the magnet of the plug, it remains attached to the plug when the user grasps the hand grip and pulls the plug out of the drain hole. A disc-shaped flexible rubber splash-guard is positioned between the magnet and the hand grip to i) prevent the fingers of the user from making contact with the hot oil pan, and ii) prevent the drops of oil draining out of the drain hole from burning the hand of the user while the stem of the plug is being removed from the drain hole of the oil pan.

It will be understood that the embodiments described herein are merely exemplary and that a person skilled in the art may make many variations and modifications without departing from the spirit and scope of the invention. Accordingly, all such variations and modifications are intended to be included within the scope of the invention as defined in the appended claims.

I claim:

1. A device for sealing a drain hole of an oil pan, comprising:

a magnetic disc having a first surface that is sized and shaped to overlap an outer perimeter of a drain hole of an oil pan, said magnetic disc producing magnetic attractive forces which are sufficient to releasably attach said device to an outer surface of the oil pan in a threadless manner and such that said magnetic disc is positioned external to the oil pan;

a stem extending from said first surface of said magnetic disc, said stem being sized and shaped to be removably inserted into the drain hole of the oil pan so as to facilitate overlapping alignment of said first surface of said magnetic disc with the drain hole of the oil pan; and a sealing mechanism positioned on said first surface of said magnetic disc, surrounding said stem, and sized and shaped to overlap the outer perimeter of the drain hole of the oil pan such that said magnetic attractive forces position said sealing mechanism against the outer surface of the oil pan to seal the drain hole in a liquid-tight manner.

2. The device according to claim 1, further comprising orienting means for orienting said stem relative to a drain hole of an oil pan.

3. The device according to claim 1, wherein said stem includes a detent mechanism adapted to assist in the releasable attachment of said plug to an oil pan.

4. The device according to claim 3, wherein said detent mechanism includes at least one projection extending radially outward from said stem.

5. The device according to claim 4, wherein said at least one projection is movable between an extended position, in which said at least one projection extends radially outward from said stem a first distance, and a retracted position, in which said at least one projection extends radially outward from said stem a second distance which is less than said first distance.

6. The device according to claim 5, wherein said at least one projection is resiliently urged from said retracted position to said extended position.

7. The device according to claim 6, wherein said at least one projection includes a first projection on one side of said stem and a second projection on another side of said stem.

8. The device according to claim 1, wherein said sealing mechanism includes a gasket.

9. The device according to claim 1, wherein said sealing mechanism includes a rubber coating.

10. The device according to claim 1, wherein said sealing mechanism extends beyond a peripheral edge of said magnetic body.

11. The device according to claim 1, wherein said stem is made from magnetic conducting material, whereby said stem is enabled to attract metallic particles to exterior surfaces of said stem.

12. A device for sealing a drain hole of an oil pan, comprising:

a plug dimensioned to obstruct a drain hole of an oil pan, said plug including a magnetic body;

a sealing mechanism positioned on said plug such that magnetic forces emanating from said magnetic body releasably attach said plug to an oil pan so as to obstruct a drain hole therein, which is sealed in a liquid-tight manner by said sealing mechanism; and orienting means for orienting said plug relative to a drain hole of an oil pan, said orienting means including a stem which projects outwardly from a first side of said magnetic body, said stem being made from magnetic conducting material whereby said stem is enabled to attract metallic particles to exterior surfaces of said stem, wherein said stem includes a plurality of through bores to thereby increase the exterior surface area of said stem.

13. A device according to claim 12, wherein said orienting means includes at least one projection extending radially outward from said stem.

14. The device according to claim 13, wherein said at least one projection is movable between an extended position, in which said at least one projection extends radially outward from said stem a first distance, and a retracted position, in which said at least one projection extends radially outward from said stem a second distance which is less than said first distance.

15. The device according to claim 14, wherein said at least one projection is resiliently urged from said retracted position to said extended position.

16. The device according to claim 13, wherein said at least one projection includes a first projection on one side of said stem and a second projection on another side of said stem.

17. The device according to claim 13, wherein said sealing mechanism includes a compliant member positioned on said first side of said magnetic body.

18. The device according to claim 17, wherein said compliant member is made from material that is selected from a group consisting of fluorosilicone and rubber.

* * * * *